United States Patent [19]

Henderson et al.

[11] Patent Number: 4,895,174

[45] Date of Patent: Jan. 23, 1990

[54] TOBACCO PARTICLE SEPARATOR

[75] Inventors: Calvin W. Henderson, Winston-Salem, N.C.; Stephen C. Jens, Ashland, Mass.; Malcolm E. Taylor, Pelham, N.H.

[73] Assignee: R. J. Reynolds Tobacco Company, Winston-Salem, N.C.

[21] Appl. No.: 195,925

[22] Filed: May 19, 1988

[51] Int. Cl.[4] ..... A24B 7/14; A24C 5/32; A24C 5/39

[52] U.S. Cl. ..... 131/110; 131/96; 131/296

[58] Field of Search ..... 131/96, 296, 110

[56] References Cited

U.S. PATENT DOCUMENTS

| | | | |
|---|---|---|---|
| 3,026,880 | 3/1962 | Perrin . | |
| 3,209,762 | 10/1965 | Molins et al. | 131/110 |
| 3,270,279 | 8/1966 | Jackson et al. | 131/110 |
| 3,757,799 | 9/1973 | Di Ianni et al. . | |
| 4,018,674 | 4/1977 | Morris . | |
| 4,083,499 | 4/1978 | Thatcher . | |
| 4,117,852 | 10/1978 | Newman et al. | 131/96 |
| 4,278,100 | 7/1981 | Thatcher | 131/96 |
| 4,475,562 | 10/1984 | Thatcher et al. | 131/110 |
| 4,523,598 | 6/1985 | Weiss et al. | 131/296 |
| 4,697,604 | 10/1987 | Brown et al. | 131/296 |
| 4,763,673 | 8/1988 | Barnes et al. | 131/96 |

FOREIGN PATENT DOCUMENTS

| | | | |
|---|---|---|---|
| 0892271 | 3/1962 | United Kingdom | 131/96 |

*Primary Examiner*—Richard J. Apley
*Assistant Examiner*—Joe H. Cheng
*Attorney, Agent, or Firm*—Grover M. Myers

[57] ABSTRACT

A tobacco particles separator utilizes turbulent air flow, flow vortices, and a random spread matrix in an air circulation path to separate and singularize tobacco particles. A moving porous web is used to receive and to hold the separated particles which may be retained on the porous web for subsequent analysis.

18 Claims, 4 Drawing Sheets

TOBACCO PARTICLE SEPARATOR

FIELD OF THE INVENTION

The present invention is directed generally to a tobacco particle separator. More particularly, the present invention is directed to a tobacco particle separator for separating and singularizing the tobacco particles contained in a cigarette tobacco rod. Most specifically, the present invention is directed to a nondestructive tobacco particle singularizing and fixative assembly. The tobacco in a cigarette tobacco rod is separated and randomized so that its various constituent parts can be analyzed by, for example a machine vision system. Separation and randomization is accomplished by use of high velocity, turbulent air flow in an air circulation path, and by use of a random spread matrix arrangement. Once the tobacco particles have been separated and randomized, they are deposited onto a porous web so that they may then be subjected to suitable analysis.

DESCRIPTION OF THE PRIOR ART

The tobacco used in the making of cigarettes is typically not all of one type but instead is a blend of various tobaccos. These various tobaccos are mixed together in a particular ratio, and having certain particle sizes, that will produce a mixture which is acceptable both to the manufacturer and to the consumer. Each cigarette producer may have several different tobacco blend formulas or mixtures which he uses in various ones of his products. Each of these blend mixtures is apt to have different types, sizes, and colors of tobacco particles, all of which are mixed together in large quantities and then formed into tobacco rods which are used to produce cigarettes.

It is frequently desirable to analyze a cigarette tobacco rod to ascertain the characteristics of the tobacco blend that is being used. This may be done by one manufacturer who is interested in learning what the mixture, which his competitor is using, has for its makeup. This analysis may also be done by the manufacturer to check his own product to be sure that the tobacco blend in his tobacco rod is as it is supposed to be. Various testing organizations may also find it necessary to subject the tobacco rod portions of various cigarettes to analysis. This may be done to insure that the tobacco has not been contaminated with inappropriate materials, or may be done as a means for evaluating the quality of the tobacco products used. In any instance, there often arise situations in which it is desirable to separate and singularize the tobacco particles in a tobacco rod.

The separation and singularizing of tobacco particles has, in the past, been accomplished manually. The cigarette wrapping paper has been removed from the tobacco rod and the tobacco particles have been manually separated so that the individual particles may then be spread apart so that each particle can be individually examined. This allows the particles of tobacco to be analyzed for size, tobacco type, color and the like. As may be readily appreciated, this manual tobacco particle separation and singularizing is a very painstaking and labor intensive procedure. While it may not be too onerous to perform such a task once, when such separation and singularizing is to be done on a continuing basis or on a large number of products, it will be readily apparent that the manual separation procedure of the prior art is totally unacceptable.

An associated problem which is encountered during tobacco particle separation and singularizing is one of particle fixation after separation. Tobacco particles are quite light and are easily displaced. Thus not only must they be separated, they must also be fixed or stabilized so that they can be analyzed and counted. In a manual separation procedure, it is difficult to secure the separated particles so that they do not become displaced or blown about.

It will thus be apparent that there is a need for a tobacco particle separator which can separate, singularize and fix the tobacco particles in cigarette rods in a dependable, expeditious manner. The tobacco particle separator of the present invention provides such a device.

SUMMARY OF THE INVENTION

It is an object of the present invention to provide a tobacco particle separator.

Another object of the present invention is to provide a tobacco particle separator for separating tobacco particles in cigarette rods.

A further object of the present invention is to provide a tobacco particle separation and singularizing assembly.

Yet another object of the present invention is to provide a tobacco particle separator which utilizes turbulent air.

Still a further object of the present invention is to provide a tobacco particle separator system which includes tobacco particle fixature capabilities.

Even yet another object of the present invention is to provide a tobacco particle separator which fully randomizes the separated particles.

Still yet a further object of the present invention is to provide a tobacco particle separator which is automatic and requires no manual particle separation.

As will be discussed in detail in the description of the preferred embodiment which is set forth subsequently, the tobacco particle separator in accordance with the present invention is comprised of an air circulating assembly which utilizes turbulent air flow to separate a tobacco rod into its particles and to singularize the separated particles. The cigarette is placed in a holder and high pressure air is used to remove the tobacco particles in the tobacco rod from the cigarette paper and to place the particles in a turbulent air stream in an air circulation path. The tobacco particles are carried by this turbulent stream of air into the top of an enlarged hopper. The decrease in air velocity within the hopper causes the tobacco particles to separate even further in an explosion-like manner. As the separated tobacco particles pass downwardly through the hopper, they strike a random spread matrix which serves as a final separating and randomizing assembly. A screen plate is placed beneath this matrix and is overlaid by a rapidly movable web of air porous adhesive treated paper or the like. The separated tobacco particles contact this web and adhere to its surface. The web is removed from beneath the hopper and may then be subjected to later analysis under machine vision or the like.

In marked contrast with prior art manual particle separation techniques, the tobacco particle separator of the present invention requires little manual manipulation. The cigarette is placed in the holder and the tobacco is extracted by high pressure air. A turbulent air stream and a hopper assembly with a matrix of rods is used to rapidly and completely separate the tobacco particles. These separated particles are then caught and held on a movable web for subsequent analysis. All of this is done in a matter of seconds and can be done repeatedly with a number of cigarettes in rapid succession. The painstakingly slow and inefficient manual particle separation procedure of the prior art is rendered obsolete by the present invention. It is no longer necessary for the tobacco rods to be taken apart by hand and to be separated and singularized on a particle by particle basis. This tobacco particle separator assembly thus clearly provides a large time savings. It also provides more efficient tobacco particle separation and singularizing than could be done manually. Thus the tobacco particle separator in accordance with the present invention is a significant improvement over the prior art and provides a substantial advance in the art.

BRIEF DESCRIPTION OF THE DRAWINGS

While the novel features of the tobacco particle separator in accordance with the present invention are set forth with particularity in the appended claims, a full and complete understanding of the invention may be had by referring to the detailed description of the preferred embodiment, as is set forth subsequently, and as is illustrated in the accompanying drawings in which;

DESCRIPTION OF THE PREFERRED EMBODIMENT

Figure 1:
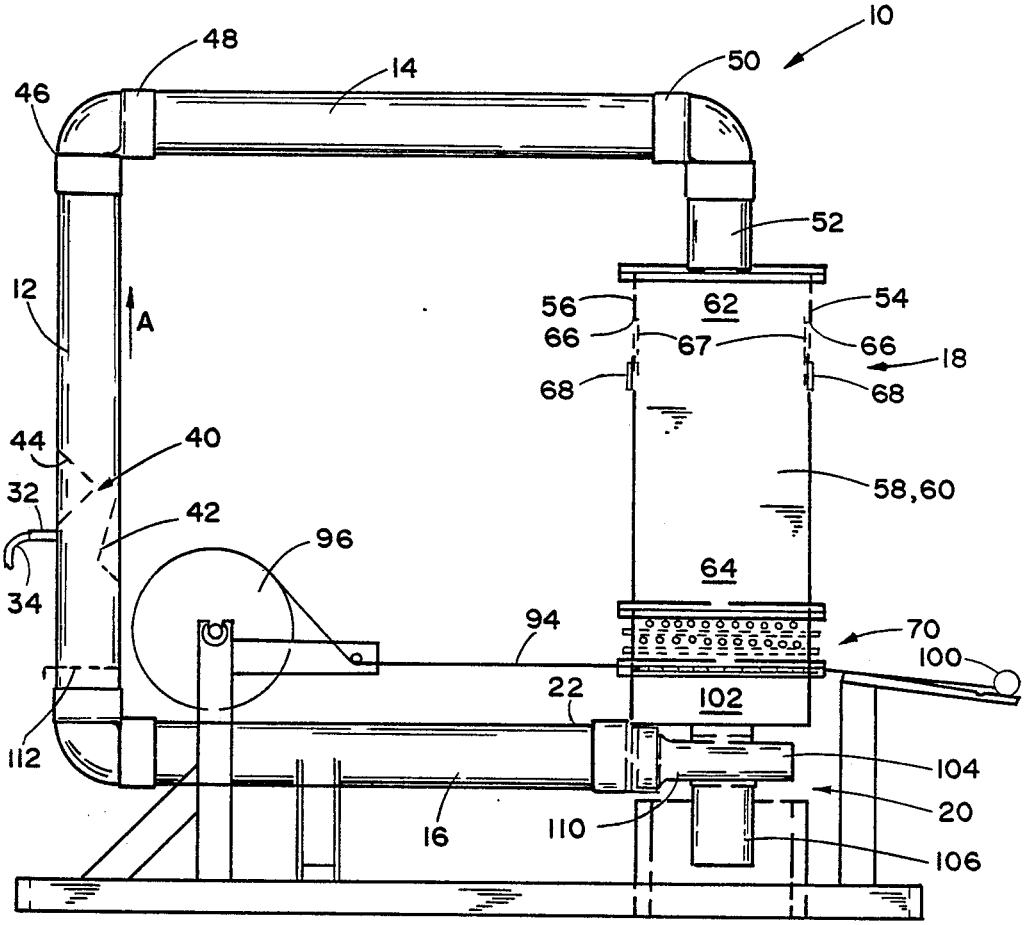
FIG. 1 is a side elevation view of the tobacco particle separation in accordance with the present invention.

Referring initially to FIG. 1, there may be seen a preferred embodiment of a tobacco particle separator, generally at 10, in accordance with the present invention. The tobacco particle separator 10 utilizes the principle of turbulent air flow in an air circulation path assembly to separate tobacco in a tobacco rod portion of a cigarette into a random, singularized array of tobacco particles which are deposited on a web for later analysis, preferably through the use of a machine vision system. The tobacco particle separator 10 in accordance with the present invention will be discussed hereinafter for use in separation of tobacco particles in a cigarette's tobacco rod. It will, however, be understood that tobacco particles from other sources and that other, non-tobacco particle arrays could also be separated by use of the tobacco particle separator 10 of the subject invention.

Figure 3:
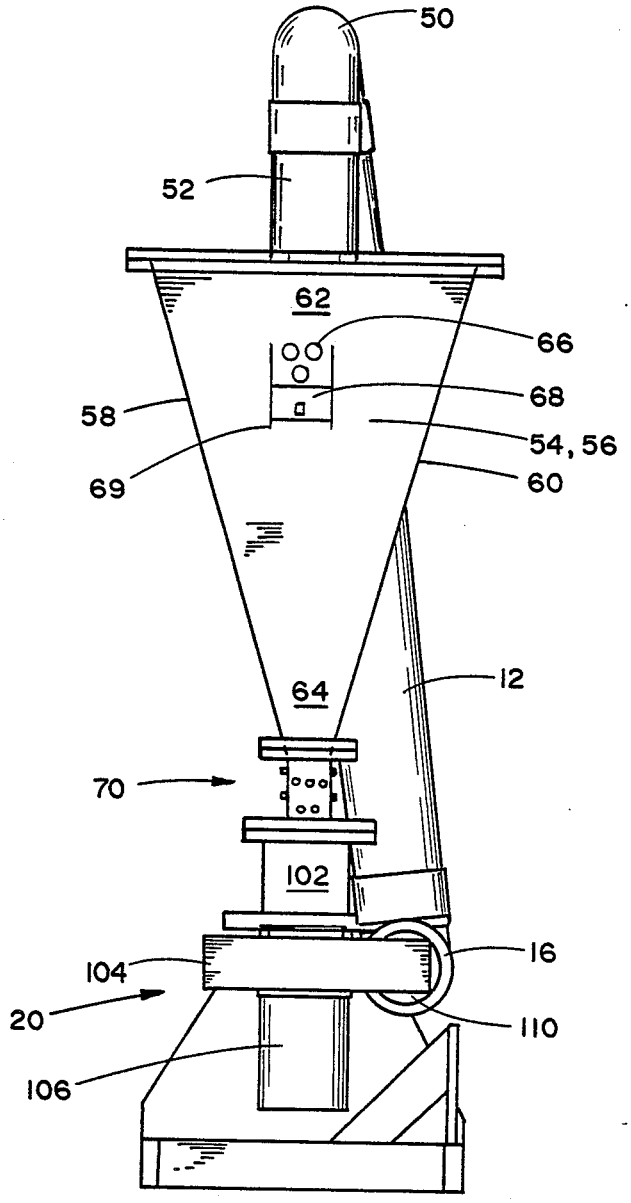
FIG. 3 is an end elevation view of the tobacco particle separator.

As may be seen most clearly in FIGS. 1 and 3 tobacco particle separator 10 is an air circulation path assembly comprised generally of a plurality of sections of piping which form an upward vertical air flow conduit 12, an upper horizontal air flow conduit 14 and a lower horizontal air flow conduit 16. A downward air flow hopper, generally at 18 and an air blower assembly, generally at 20 complete the air circulation path. The air flow direction in this closed loop is generally in a clockwise direction as indicated by arrow A in FIG. 1. This is accomplished by attaching the intake side of blower assembly 20 to the base of hopper 18 and by attaching a first end 22 of lower air flow conduit 16 to the discharge side of blower 20. Thus air is caused to flow in a clockwise loop through the tobacco particle separator 10 so long as blower 20 is in operation.

Figure 2:
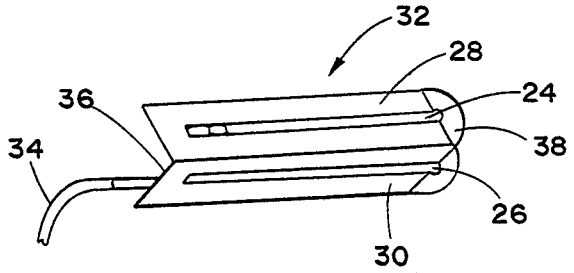
FIG. 2 is a perspective view of a cigarette clamp usable in the tobacco particle separator.

A cigarette (not specifically shown), whose tobacco rod particles are to be separated, is placed in an elongated channel formed by complimentary upper and lower grooves 24 and 26 in upper and lower halves 28 and 30, respectively of a cigarette clamp 32 which is shown in FIG. 2. Suitable means, such as small radially inwardly directed projections or the like which are not specifically shown in FIG. 2, may be used to hold the cigarette, which is typically a filter cigarette, in the elongated channel in cigarette clamp 32. An air line 34 is joined to a rear portion 36 of cigarette clamp 32 and communicates with the elongated channel formed by upper and lower grooves 24 and 26. Once a cigarette has been placed in clamp 32 and the upper and lower halves 28 and 30 have been brought together, a short blast of high pressure air supplied through air line 34 will be sufficient to separate the tobacco rod from the cigarette filter and wrapping paper which will be retained in clamp 32. The tobacco rod will be blown out of clamp 32 through the opening formed in a front end 38 of the clamp.

Turning again to FIG. 1, cigarette clamp 32 is attachable to upward air flow conduit 12 of tobacco particle separator 10 generally adjacent an arrangement of internal turbulence generating baffles 40. These are depicted in FIG. 1 as a pair of spaced, generally triangular shaped projections 42 and 44 secured to an inner surface of upward air flow conduit 12. It will be apparent that other shapes and spacing arrangements for these turbulence generating baffles 40 could be selected, if desired. As discussed above, a cigarette is placed in clamp 32 and the front end 38 of clamp 32 is inserted into upward air flow conduit 12. A blast or puff of high pressure air, fed into clamp 32 through air line 34, forces the tobacco rod into upward air flow conduit 12 generally adjacent the turbulence creating baffles 40. This starts the separation of the tobacco particles from a tobacco rod into a random, singularized array of particles.

The tobacco particles are carried up through upward air flow conduit 12 by the turbulent air flow generated by blower 20. The particles change direction at the top 46 of upward air flow conduit 12 and enter a first end 48 of upper air flow conduit 14. As the particles travel across through upper air flow conduit 14, generally in a left to right direction, as seen in FIG. 1, the turbulence in the closed loop air flow path, created in part by turbulence generating baffles 40, is maintained and continues the process of tobacco particle separation and singularizing. Once the turbulent air flow and its entrained tobacco particles reach a second end 50 of upper air flow conduit 14, the direction of flow is again changed and the air flow and particles are directed downwardly into a hopper infeed conduit 52 for delivery to hopper 18.

As is best seen in FIGS. 1 and 3, hopper 18 is generally in the shape of an inverted truncated wedge or pyramid. Hopper 18 has spaced, generally vertical side walls 54 and 56 which are shaped as inverted trapezoids. Spaced, generally rectangular and inwardly sloping front and rear walls 58 and 60 complete the hopper 18 and form a structure which has a larger cross-sectional area at an upper, inlet portion 62 and a smaller cross-sectional area at a lower, discharge portion 64.

The tobacco particles are, as discussed above, carried through hopper infeed conduit 52 into the upper, enlarged cross-sectional portion 62 of hopper 18. The rapid increase in volume experienced by the air flow as it enters upper portion 62 of hopper 18 creates a substantial velocity reduction in the air flow and this sets up primary and secondary flow vortices. The result of this sudden velocity reduction is to cause a rapid expansive effect thereby more widely separating the tobacco particles to further singularized them in the upper portion 62 of the hopper 18.

It is important to control the air flow in hopper 18 to create sufficient turbulent air flow for effective particle separation while avoiding over-pressurization of the hopper. Such over-pressurization could cause escape of the tobacco particles through the bottom discharge portion 64 of the hopper. One or more air outlets, generally indicated at 66 in FIGS. 1 and 3 are formed in the side walls 54 and 56 of hopper 18. A suitable filter medium 67 is placed over these air outlets on the interior of hopper 18 and slidable air outlet control doors 68 may be slidably carried in tracks 69 on the outer surfaces of side walls 54 and 56 of hopper 18. The particular number of these air outlets 66 and the structure of the control doors 68 may be varied as needed or desired to insure proper turbulent air flow in hopper 18 while avoiding hopper over-pressurization.

Figure 4:
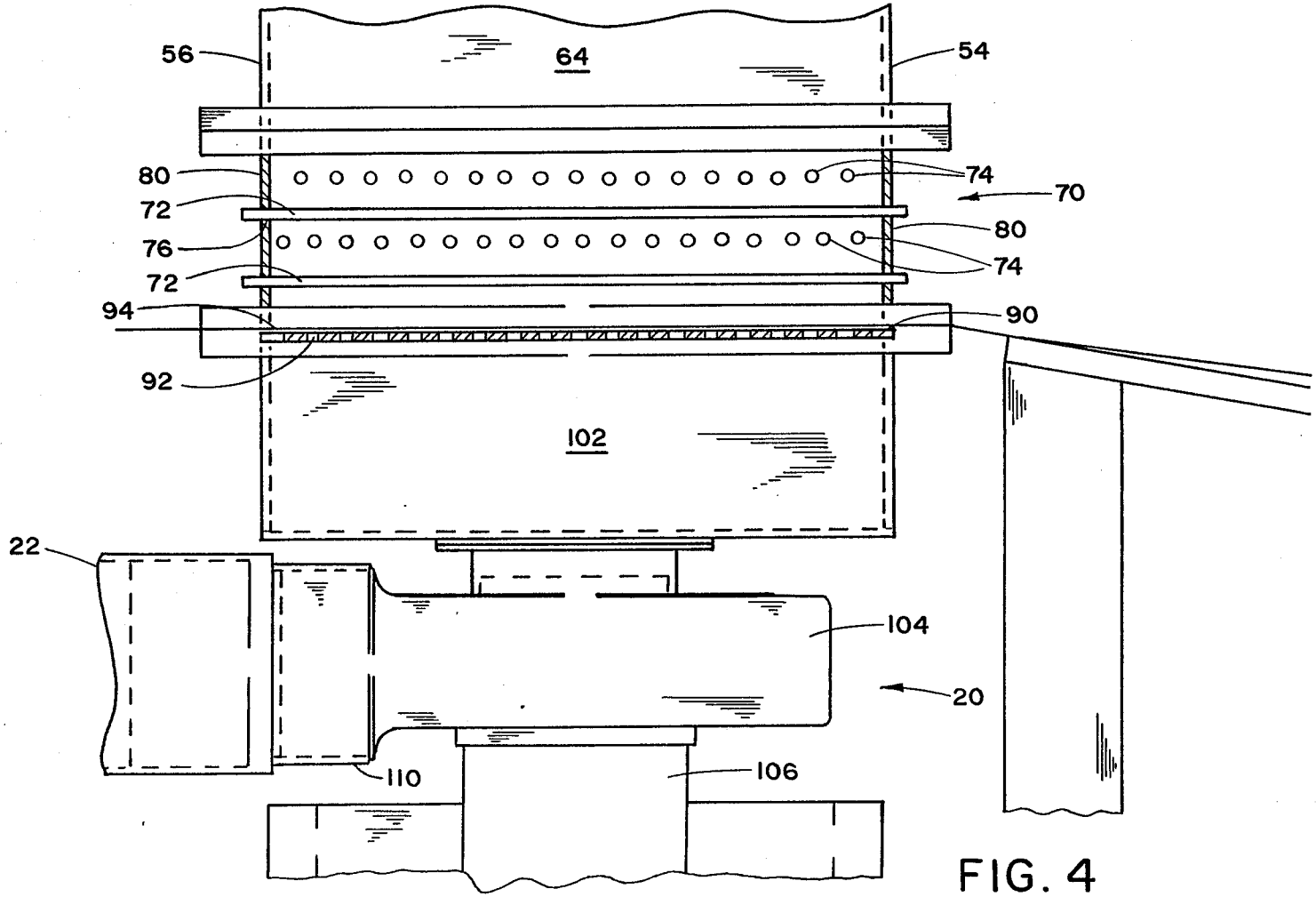
FIG. 4 is an enlarged side elevation view, partly in section, of a portion of the tobacco particle separator.
Figure 5:
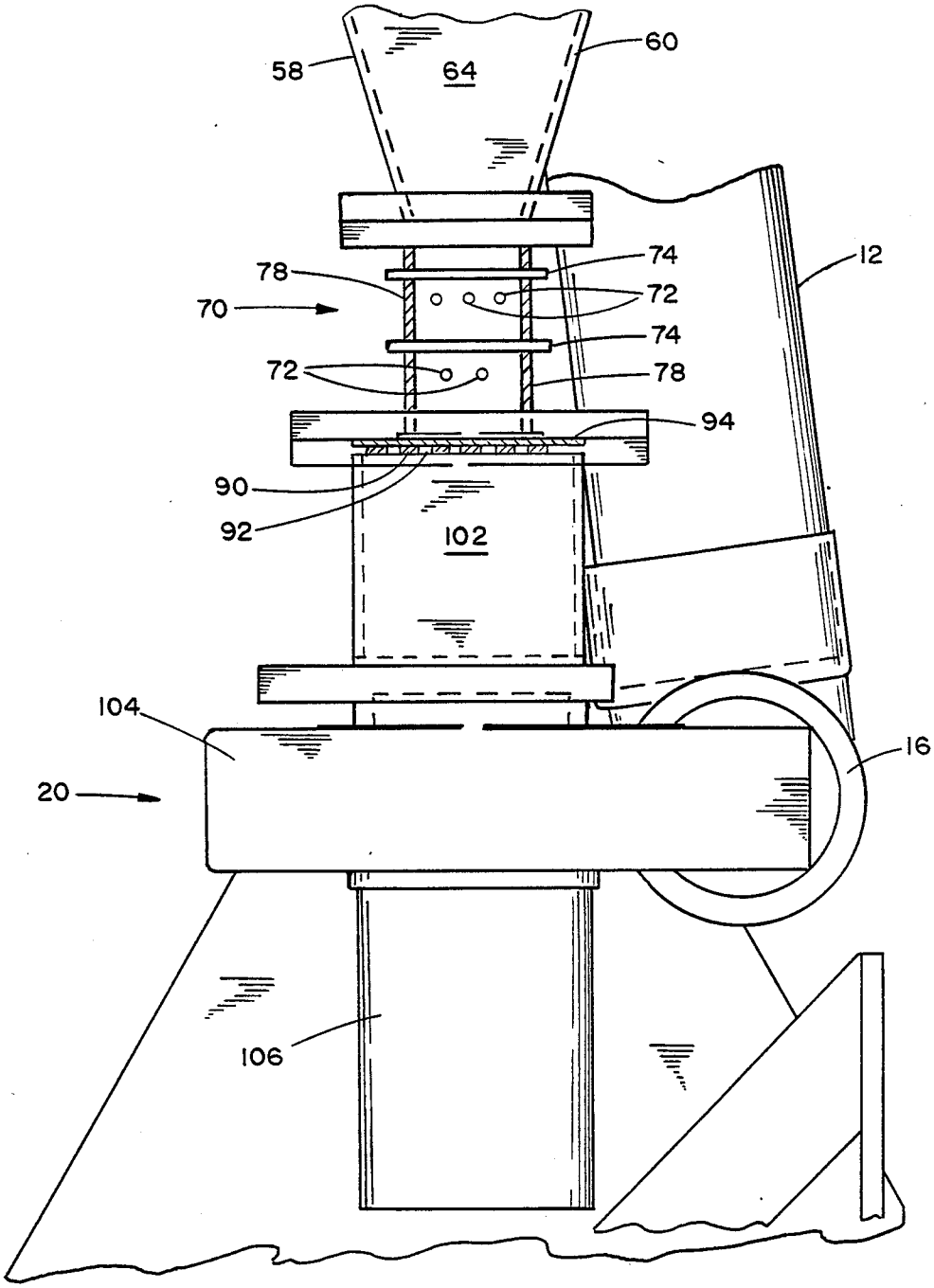
FIG. 5 is an end elevation view of the portion of the tobacco rod separator shown in FIG. 4.

A random spread matrix, generally at 70, may be seen most clearly in FIGS. 4 and 5 as being situated beneath the lower portion 64 of hopper 18. Random spread matrix 70 may be comprised of superimposed alternating layers of long longitudinal rods 72 and short transverse rods 74. These rods may be held in place by being inserted through suitable apertures 76 in longitudinal and transverse matrix chamber side walls 78 and 80, respectively. It will be understood that the longitudinal rods 72 are carried by the transverse matrix chamber walls 80 and that the transverse rods 74 are carried by the longitudinal matrix chamber walls 78. In the preferred embodiment, the matrix rods 72 and 74 are formed of plexiglass. It will be understood that any suitable material could be used to form these rods. It will further be understood that the specific matrix array shown in FIGS. 4 and 5 could be varied as could the means for supporting the matrix rods beneath the lower, reduced cross-sectional discharge end of hopper 18.

The random spread matrix 70, as its name suggests, further randomizes the tobacco particles as they fall, and are pulled by the suction side of fan or blower 20 down through hopper 18. The surfaces of the matrix rods 72 and 74 are smooth and do not present a surface to which any of the tobacco particles are apt to cling. The random spread matrix 70 also effectively separates any clumps or interconnected groups of tobacco particles which may have not been randomized and singulated in the turbulent air flow conduits 12 and 14 or the vortex generating hopper 18.

A porous metal plate 90 is positioned in a generally horizontal orientation beneath the random spread matrix 70. Metal plate 90 has a plurality of spaced openings 92 whose sizes are exaggerated in FIGS. 4 and 5. In the preferred embodiment, metal plate 90 has a 100 micron porosity which does not interfere with air flow but which is small enough to prevent passage of tobacco particles therethrough. A porous collection and fixature medium, such as a web of porous paper 94, is supported on an upper surface of porous metal plate 90. This porous web 94 is delivered from a supply reel 96, as seen in FIG. 1, passes beneath the random spread matrix 70 over porous metal plate 90, and is taken up by a driven take-up and storage reel 100. The porous web 94 may be provided with an adhesive on its upper surface or alternatively could cooperate with a separately applied overlying film, which would be put in place after collection of the tobacco particles on the porous web 94. In either instance, the porous web 94 receives and holds the separated tobacco particles so that they can be inspected and analyzed in a subsequent process. The porous web 94 has a width which is at least as great as the transverse width of the random spread matrix chamber. Web 94 is moved in a longitudinal direction beneath matrix 70; i.e., parallel to longitudinal rods 72, at a sufficient rate of speed so that there is very little likelihood of separated tobacco particles landing on previously web attached particles. To this end, the speed of the longitudinal travel of web 94 may be controlled by control of the speed of take-up reel assembly 100. In the preferred embodiment, the area of web 94 which overlies the porous metal plate is generally about 54 square inches. The take-up reel assembly 100 is driven by any suitable electric motor, not specifically shown, so as to provide a web travel speed of generally about 4 to 5 feet/second. Thus in a two second run of the tobacco particle separator approximately 8 to 10 feet of web 94 will be advanced across the upper surface of porous metal plate 90.

An intake or suction side plenum chamber 102 for air blower assembly 20 is located beneath porous metal plate 90. Air blower 20 may be any suitable type such, as for example one having radial blades carried in a fan housing 104. A suitable electric drive motor 106 is provided for air blower 20. In the preferred embodiment, air blower 20 is driven by a one horsepower motor and produces an air flow having a velocity of 6 ft/sec. and a flow rate of 70 cfm. The suction created in the matrix chamber and in suction plenum chamber 102 aids in pulling the tobacco particles downwardly from the hopper 18, through the random spread matrix 70 and fixature of the particles on the porous web 94. Since the width of the web 94 is as great as the width of the air flow passage beneath the random spread matrix 70, all of the separated and singulated tobacco particles are collected on porous web 94.

A discharge or pressure outlet 110 of fan housing 104 delivers air flow to the inlet end 22 of lower horizontal air flow conduit 16. This air can then start another circuit through the air circulation path of tobacco particle separator 10. Any stems or tobacco particles that are not picked up by the air flow may be separated out by use of a removable screen 112 that may be located before, in the direction of air flow, cigarette clamp 32. It may also be desirable to provide a clean out door (not shown) in a leg of the air flow conduit so that the occasional particles of dust or the like may be removed. Further, while the preferred embodiment utilizes a single air blower assembly 20 to provide both air flow and suction in the air circulation path, it would be possible to provide an air blower assembly just before the air turbulence generating baffles 40 and a separate suction device beneath the hopper 18. In such an arrangement, the air circulation path would not necessarily form a loop or continuous path but instead could have a first conduit upstream of the hopper 18 and a second conduit including the hopper 18 and the particle receiving means such as porous web 94 and porous metal plate 90.

In use, as has been discussed above, a cigarette is placed in clamp 32 and this clamp is attached to upward air flow leg 12. If air blower 20 is not already running, it is turned on to generate air flow in the air circulation path. A short burst of high pressure air is then delivered to cigarette clamp 32 through air line 34 thereby forcing the tobacco rod into the air flow. The tobacco particles are carried along the air circulation path, into the hopper 18 and down through the random spread matrix 70. They are then deposited on the surface of the longitudinally moving porous web 94 where they are held by an adhesive, or other means such as a separately applied film. Various interlocks and controls may be provided to control the operational sequence of the tobacco particle separator. These will insure that the take up reel 100 must be operating before the air blower 20 can be turned on. In actual test usage, the tobacco particle separator in accordance with the present invention has been able to attain a 98% particle separation. This efficiency, combined with the ability of the apparatus to quickly separate a number of samples in succession, clearly is evidence of the ability of the tobacco particle separator of the present invention to perform its intended function in an efficient, expeditious manner.

While a preferred embodiment of a tobacco particle separator in accordance with the present invention has been fully and completely set forth hereinabove, it will be apparent to one of skill in the art that various changes in, for example, the sizes and shapes of the air flow legs, the shape of the hopper, the size of the air blower, the specific type of porous web and the like could made without departing from the true spirit and scope of the subject invention which is accordingly to be limited only by the following claims.

What is claimed is:

1. A tobacco particle separator for separating and singularizing tobacco particles, said separator comprising:

an air flow circulation path, said air flow circulation path including at least a first air flow conduit;

means to introduce tobacco particles into said air flow circulation path prior, in the direction of air flow, to said first air flow conduit for separation and singularizing of said tobacco particles;

a particle separating and singularizing hopper in said air flow circulation path subsequent, in the direction of air flow, to said first air flow conduit;

means for receiving and retaining tobacco particles from said hopper in separated and singularized condition; and means for generating a flow of air in said air flow circulation path prior, in the direction of air flow, to said tobacco particle introduction means;

wherein said means to introduce tobacco particles into said path includes a cigarette clamp removably positionable in said path before said hopper.

2. The tobacco particle separator of claim 1 further including means to supply high pressure air to said clamp to introduce tobacco particles into said path.

3. The tobacco particle separator of claim 1 further comprising turbulence generating means positioned in said air flow circulation path between said tobacco particle introduction means and said hopper.

4. The tobacco particle separator of claim 3 wherein said turbulence generating means are spaced projections on interior surface portions of said first air flow leg.

5. The tobacco particle separator of claim 1 wherein the cross-sectional area of said hopper is substantially greater than the cross-sectional area of said first air flow conduit.

6. The tobacco particle separator of claim 5 wherein said hopper has a large upper cross-sectional area and a small lower cross-sectional area.

7. A tobacco particle separator for separating and singularizing particles of tobacco, said separator comprising:

an air flow circulation path;

means to introduce tobacco particles into said air flow circulation path for separation and singularizing;

a random spread matrix in said air flow circulation path subsequent, in the direction of air flow, to said tobacco particle introduction means;

means for receiving and retaining tobacco particles from said random spread matrix in separated and singularized condition; and means for generating a flow of air in said flow circulation path;

wherein said random spread matrix includes superimposed layers of longitudinal and transverse rods.

8. The tobacco particle separator of claim 7 wherein said layers of rods are generally parallel to each other and wherein said rods in each of said layers are generally transverse to rods in adjacent ones of said layers.

9. The tobacco particle separator of claim 7 wherein said means for receiving and retaining tobacco particles includes a porous metal plate positioned beneath, and spaced from said random spread matrix.

10. The tobacco particle separator of claim 9 wherein said means for receiving and retaining tobacco particles additionally includes a porous web positioned overlying said metal plate.

11. The tobacco particle separator of claim 10 further including means to cause said porous web to move across an upper surface of said metal plate.

12. The tobacco particle separator of claim 10 wherein said porous web includes means to retain tobacco particles in said separated and singularizing condition on an upper surface of said web.

13. The tobacco particle separator of claim 1 wherein said means for generating a flow of air is an air blower.

14. The tobacco particle separator of claim 13 wherein an air intake plenum for said air blower is positioned beneath said means for receiving and retaining tobacco particles.

15. A particle separator for separating and singulating particles, said separator comprising:

an air flow circulation path;

means to introduce particles to be separated into said air flow circulation path;

a turbulence generating hopper in said air flow circulation path subsequent to said particle introduction means;

a separated particle receiving zone situated at a discharge portion of said hopper;

a porous particle receiving and retaining web movably positioned in said separated particle receiving zone; and means for generating air flow in said air flow circulation path.

16. The particle separator of claim 15 wherein said porous web is caused to move through said separated particle receiving zone at a rate sufficient to disperse said separated particles on a surface portion of said web having an area greater than the area of said separated particle receiving zone.

17. The particle separator of claim 16 wherein said porous web is pulled through said separated particle receiving zone by a driven take up reel.

18. The partial separator of claim 17 wherein said take up reel and said air flow generator are caused to operate concurrently.

* * * * *